US006705560B1

(12) United States Patent
Rågård et al.

(10) Patent No.: US 6,705,560 B1
(45) Date of Patent: Mar. 16, 2004

(54) METHOD FOR WINDING A TISSUE WEB IN A REEL-UP IN A PAPER MACHINE

(75) Inventors: Johan Rågård, Karlstad (SE); Sören Eriksson, Charlotte, NC (US); Lars-Erik Roland Önnerlöv, Karlstad (SE)

(73) Assignee: Metso Paper Karlstad Aktiebolg (AB), Kalstad (SE)

( * ) Notice: Subject to any disclaimer, the term of this patent is extended or adjusted under 35 U.S.C. 154(b) by 289 days.

(21) Appl. No.: 09/723,904

(22) Filed: Nov. 28, 2000

(51) Int. Cl.[7] ..... B65H 35/10
(52) U.S. Cl. ..... 242/521; 242/532.3; 156/172
(58) Field of Search ..... 242/521, 532.3, 242/580, 583; 156/172, 171, 174, 250, 270, 291, 430, 431, 440, 458, 578; 225/106

(56) References Cited

U.S. PATENT DOCUMENTS

| | | | | |
|---|---|---|---|---|
| 3,951,890 A | | 4/1976 | Reilly et al. | |
| 4,338,147 A | | 7/1982 | Bäckström et al. | |
| 4,488,687 A | | 12/1984 | Andreasson | |
| 4,572,451 A | | 2/1986 | Ikeda et al. | |
| 4,711,405 A | | 12/1987 | Niskanen | |
| 5,009,736 A | | 4/1991 | Lehto | |
| 5,092,533 A | | 3/1992 | Gangemi | |
| 5,816,528 A | | 10/1998 | Ekström et al. | |
| 5,845,866 A | * | 12/1998 | Kaipf | 242/521 |
| 5,845,868 A | | 12/1998 | Klerelid et al. | |
| 5,901,918 A | | 5/1999 | Klerelid et al. | |
| 6,045,085 A | | 4/2000 | Andersson et al. | |
| 6,086,010 A | | 7/2000 | Kayser | |
| 6,135,000 A | | 10/2000 | Caspar et al. | |
| 6,142,207 A | | 11/2000 | Richardot | |
| 6,238,484 B1 | * | 5/2001 | Hasegawa | 118/302 |
| 6,253,818 B1 | | 7/2001 | Preinknoll | |

FOREIGN PATENT DOCUMENTS

| | | |
|---|---|---|
| EP | 0 931 744 A3 | 8/1999 |
| WO | WO 97/48632 | 12/1994 |
| WO | WO 95/15901 | 6/1995 |
| WO | WO 98/46510 | 10/1998 |

* cited by examiner

*Primary Examiner*—Donald P. Walsh
*Assistant Examiner*—Joseph Rodriguez
(74) *Attorney, Agent, or Firm*—Alston & Bird LLP

(57) ABSTRACT

A method is provided for switching reels in a paper machine that includes applying an adhesive onto a continuously running paper web to begin a new paper roll and severing the continuous paper web from the tail end of the newly completed roll. The running paper web is supported by a reel drum and wound onto exchangeable reel shafts in contact with the reel drum in order to form rolls of paper. A hopper with a heater heats an adhesive agent to temporarily lower its viscosity and stickiness for smooth and even applying. A pair of nozzles, mounted on a pair of rodless cylinders and translating therewith, spray jets containing said adhesive onto the web and/or the reel shaft. The web is then advanced onto the reel shaft thereby forming an adhesive interface between the web and the shaft. Tension is applied across the adhesive interface to sever the paper web at the adhesive interface, thereby separating the trailing end of the paper web of the previously completed roll from the current paper roll.

19 Claims, 10 Drawing Sheets

METHOD FOR WINDING A TISSUE WEB IN A REEL-UP IN A PAPER MACHINE

FIELD OF THE INVENTION

The present invention relates to papermaking machines, and more particularly relates to a method in a papermaking machine for switching the winding of a paper web from a fully wound roll onto a new empty reel shaft to start a new paper roll.

BACKGROUND OF THE INVENTION

Production speed of tissue web is of paramount importance. Production speeds for tissue webs have leveled off in recent years. This is thought to be a result of the increasing demand for high-quality tissue and the technical difficulty of maintaining higher production speeds. At higher production speeds the tissue webs tend to vibrate and rupture due to their low basis weight and tensile strength.

Reel changing comprises switching a completed paper roll with a new, empty reel shaft and initiating tissue web winding on the new reel shaft. Efficient reel changing increases overall production speed by minimizing the length of downtime between reels and the number of failed reeling attempts.

A common way to initiate tissue web winding on a new reel is by threading. Threading means that a web end is pulled along through a paper or board machine by a leader. The leader consists of a strip of web which may initially be only 40 to 50 cm wide, but gradually becomes wider until it extends across the entire width of the web. The leader is cut out in the continuous web, starting either at one edge or somewhere at an optional distance from either edge of the web, whereas its length is determined by the time it takes for the tip to extend across the entire width of the web. Due to the high web speed the leader may be very long, 180 to 200 m. This incurs considerable costs for the paper mill since the cut part of the paper web must be discarded for each paper reel.

Sanitary tissue products, usually manufactured of tissue paper, are extremely market-sensitive and the quality of the product is therefore often more important than its quantity. It is thus important that during reeling the paper reel acquires several important properties, e.g., homogeneity and lack of wrinkles, tears or folds. Furthermore, high efficiency in the following conversion machines can only be achieved if the reels of paper from the paper machine have a homogenous high quality.

Soft paper with low strength must be reeled carefully in order to keep the paper qualities such as density and elasticity as constant as possible throughout the reel. The two main factors affecting reel density are web tension and radial pressure at the nip of the reel-up. Lower nip pressure is important to obtain lower average density.

The thickness and elasticity of the web decreases from the outside of the reel to the center in a radial direction. This is because the compressive stress is built up in the paper reel during reeling and compresses the inner radial parts of the reel. This causes a decrease in thickness of the inner web layers. This effect increases if the reel is stored for too long before being rewound or converted.

Reeling problems arise when a new reel of paper is commenced with the aid of the tapered leader as mentioned above, since the web turns applied during winding of the innermost layers produce an uneven radial growth axially along the reel shaft so that the reel becomes carrot shaped. This is caused partly by the superelevation of the web and partly by differences in the nip pressure across the web. If the cross-sectional profile of the paper web differs with regard to thickness, web tension or elasticity then pleating, crushing damage, defects in web and axial forces in the reel will occur at a high nip pressure. This may, in worst cases, result in web rupture.

High web speed machines use either the threaded or full-width methods and must wrap the web around the empty reel shaft. Changing "full-width" reels in the present context refers to wrapping the entire width of the web around the reel shaft when initiating a new reeling operation. This is to be distinguished from threading using a tapered leader. At high web speeds, glue is applied to the leader itself before it is threaded. At low speeds, such as those used for tissue paper production, full-width methods assisted by balloon blowing are common. Balloon blowing entails creating slack across the full width of the web by somewhat retarding the rotation of the finished reel. With the aid of compressed air, the fold thus formed is then forced into the nip between the new reel shaft and the reel drum, after which the web is cut off. In order to increase the reliability of this type of reel switching, glue or tape is also applied, but only on the actual reel shaft before this comes into contact with the paper web.

Many methods of glue or adhesive application have been used such as manual application using a large brush or spray gun as shown in FIG. 10. Regardless of the transfer method used for switching reels, it is important that the glue is still adhesive when contact occurs between the paper web and reel shaft. It is thus desirable to use simultaneous glue spraying as opposed to manual methods. A range of conventional glue types have been used to ensure that the paper web adheres to the reel shaft.

Automatic glue spraying is accomplished with the aid of glue nozzles, generally placed at one side of the paper web, close to the primary arms. U.S. Pat. No. 6,045,085 demonstrates the use of aerosol jets for glue application. This invention mixes compressed air of predetermined amounts with the conventional liquid glue or adhesive as it exits a nozzle. The nozzle is actually one nozzle inside another, one of which sprays the compressed air and the other the liquid glue. The glue is distributed in a flat and wide fish tail pattern by several of the nozzles arranged side-by-side on a screen mounted upstream of the paper reel.

Despite the increases in speed of glue application using aerosol jets, and other automatic gluing methods, a problem remains as to the best manner for severing the existing continuous web from a completed roll. One automatic method that has been used for severing a web employs the use of water jets, or other cutting devices, sprayed at a high velocity to rupture the paper web. It is desirable to eliminate these water jets or other cutting devices.

Therefore, it would be advantageous to have a method of automatically applying glue, severing a paper web and ensuring the integrity of the glued interface to facilitate a quick and effective reel change in a papermaking machine.

SUMMARY OF THE INVENTION

The current invention meets these and other needs by providing a method for winding a traveling web of paper in which the paper web is guided toward a rotating reel shaft using a web supporting surface, such as a reel drum. An adhesive is sprayed from a spray nozzle onto at least one of the web and the reel shaft. Contact is initiated between the web and the reel shaft such that the web adheres to the reel shaft, and forms an adhesive interface that follows being winded on the reel shaft therebetween. A trailing end extends from the adhesive interface in a downstream direction while a leading end of the web extends from the adhesive interface in the upstream direction. The web is then severed at the adhesive interface by applying tension to the trailing end of the web in the downstream direction, the adhesive preventing the web from detaching from the reel shaft such that the trailing end of the web tears free of the leading end.

The adhesive is preferably heated to a predetermined temperature in a tank with a heater to render the adhesive flowable and the adhesive is then supplied to the spray nozzle. Other types of high tack (i.e., thick and sticky) adhesives may also be employed in the severing process. A second nozzle can be added for spraying the adhesive in alternative patterns such that the tear line of the web has various shapes. In a first embodiment, the first and second nozzles are positioned at the edges of the web and translated to the center of the web while spraying adhesive such that the web tears along an adhesive interface extending diagonally from the edges to the center of the web in the upstream direction. In a second embodiment, the first and second nozzles begin at the center of the web and are translated to the opposing edges of the width such that the web tears along an adhesive interface extending diagonally from the center to the edges of the web in an upstream direction. Alternatively, a plurality of fixed nozzles with overlapping spray jets can be used to spray adhesive simultaneously across the web width such that the web tears across the full width of the web.

BRIEF DESCRIPTION OF THE DRAWINGS

Figure 1:
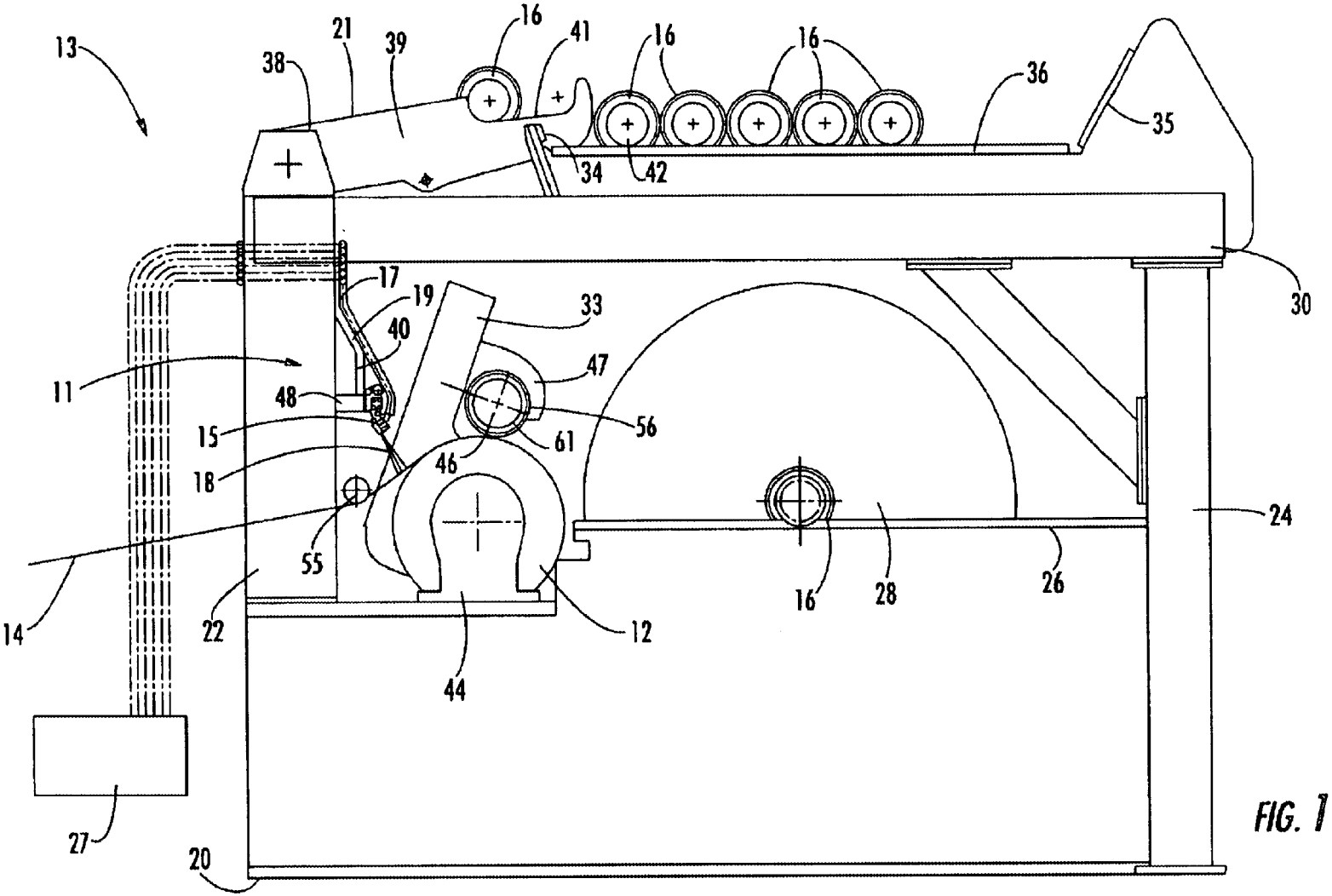

Having thus described the invention in general terms, reference will now be made to the accompanying drawings, which are not necessarily drawn to scale, and wherein:

FIG. 1 is a schematic side view of parts of a reel-up according to the invention seen from one long side showing the glue-spreading device with nozzles positioned to spray into the nip.

Figure 2:
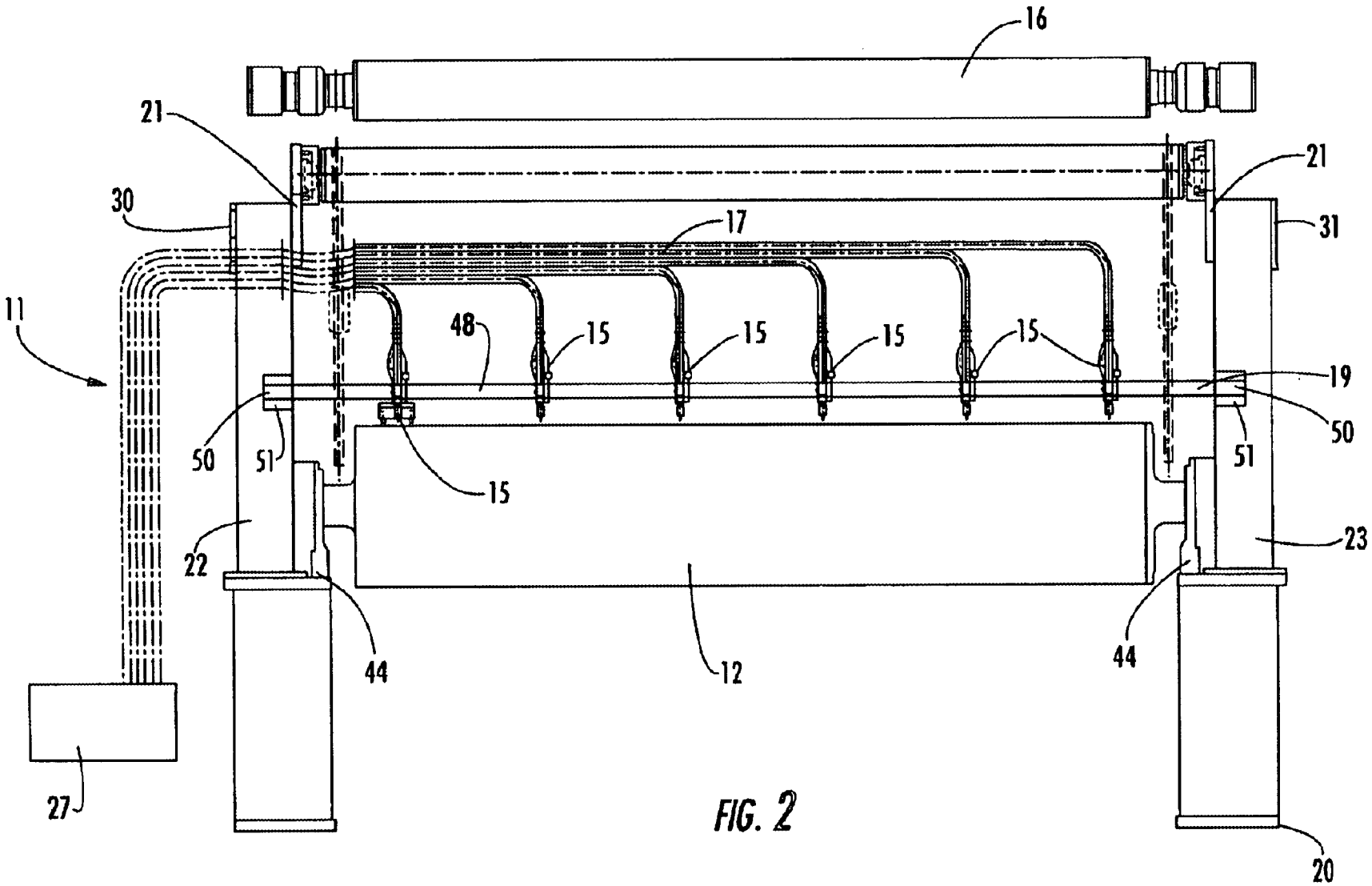

FIG. 2 is a schematic front view of the reel-up in FIG. 1 showing the arrangement of the nozzles and their respective conduits mounted transversely to the machine direction.

Figure 3:
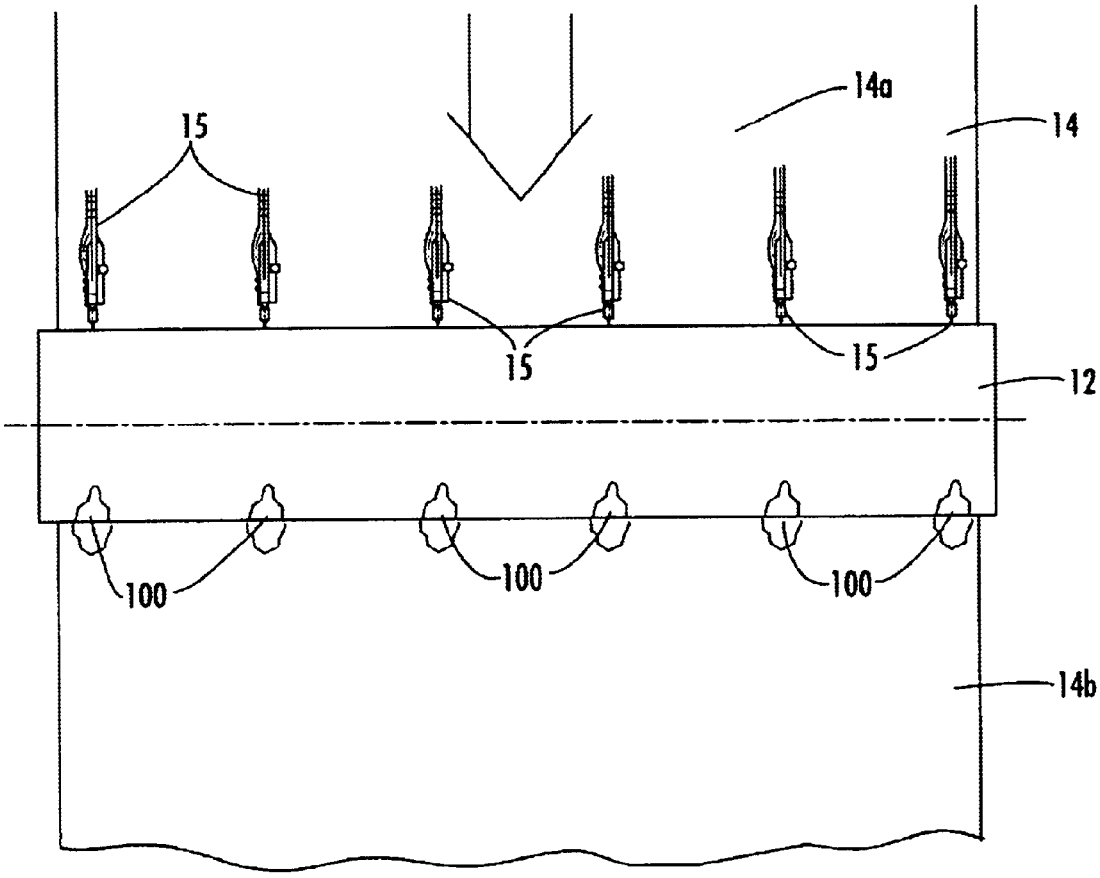

FIG. 3 is a schematic plan view of a plurality of fixed nozzles applying a full-width adhesive interface.

Figure 4:
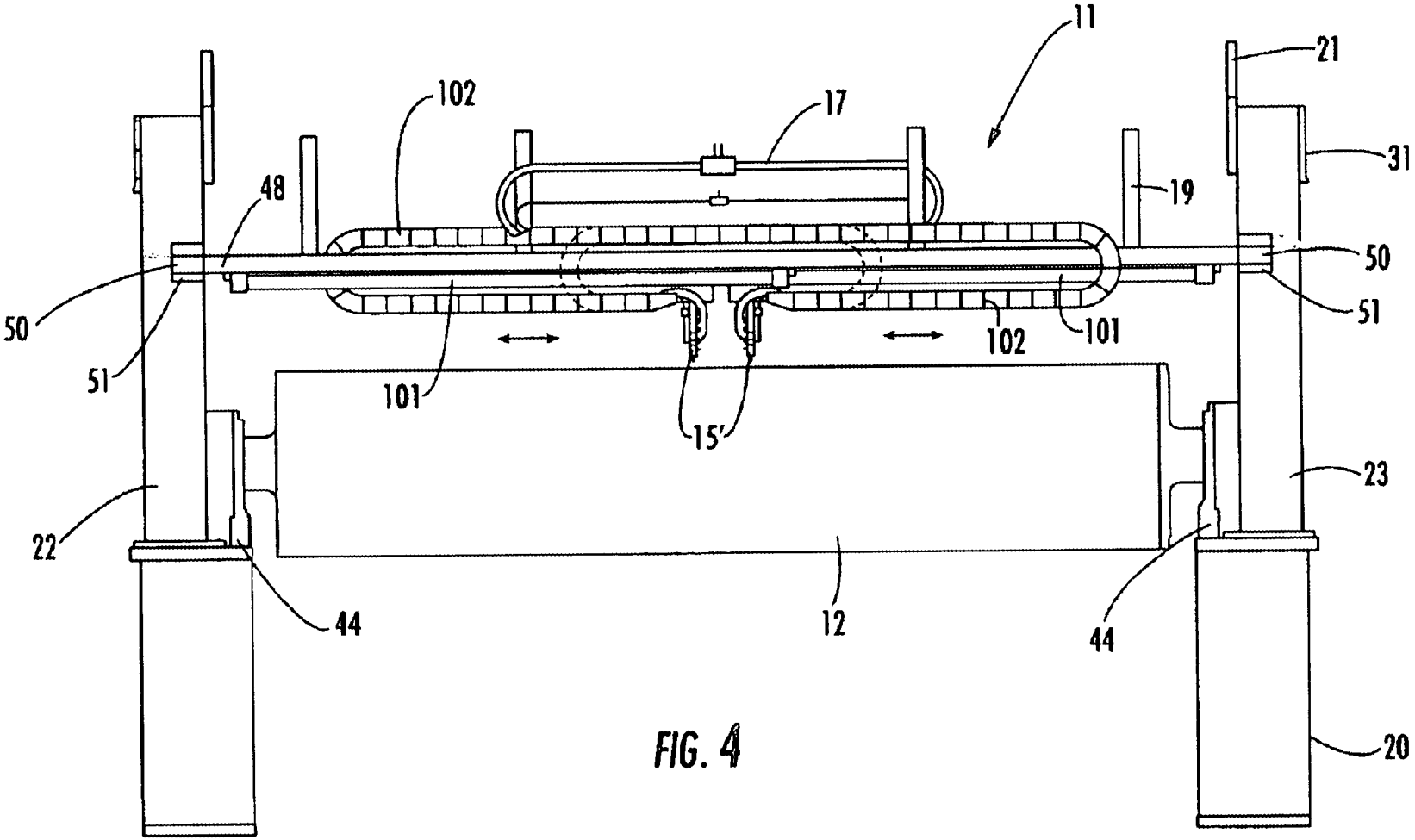

FIG. 4 is a schematic elevational view looking in the machine direction of a reel-up device in accordance with one embodiment of the invention including an adhesive dispenser for severing a tissue web, showing a pair of translatable nozzles in positions near the center of the web width.

Figure 5:
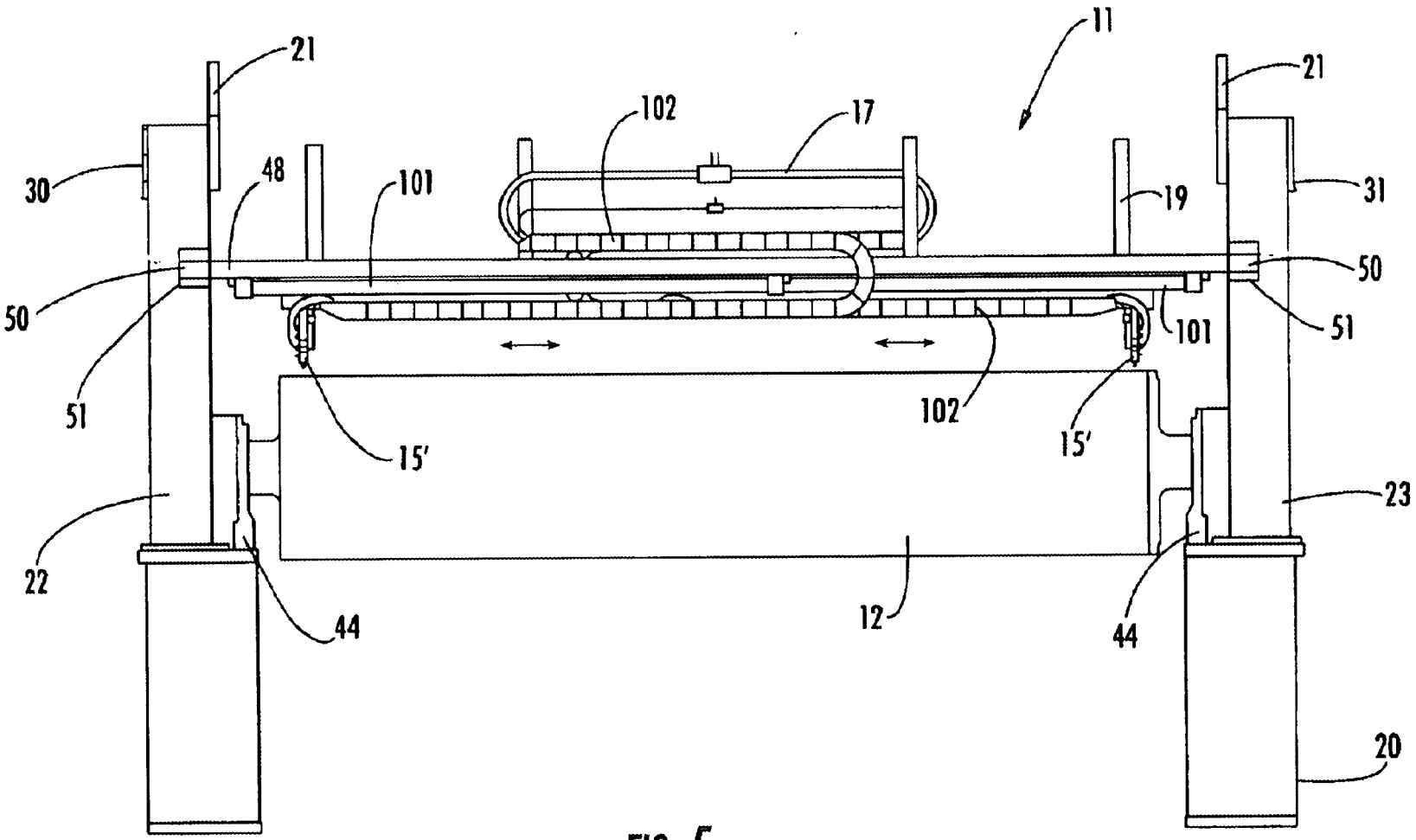

FIG. 5 is a schematic front view of the reel-up device in FIG. 3 with the pair of translatable nozzles translated to the edges of the web.

Figure 6:
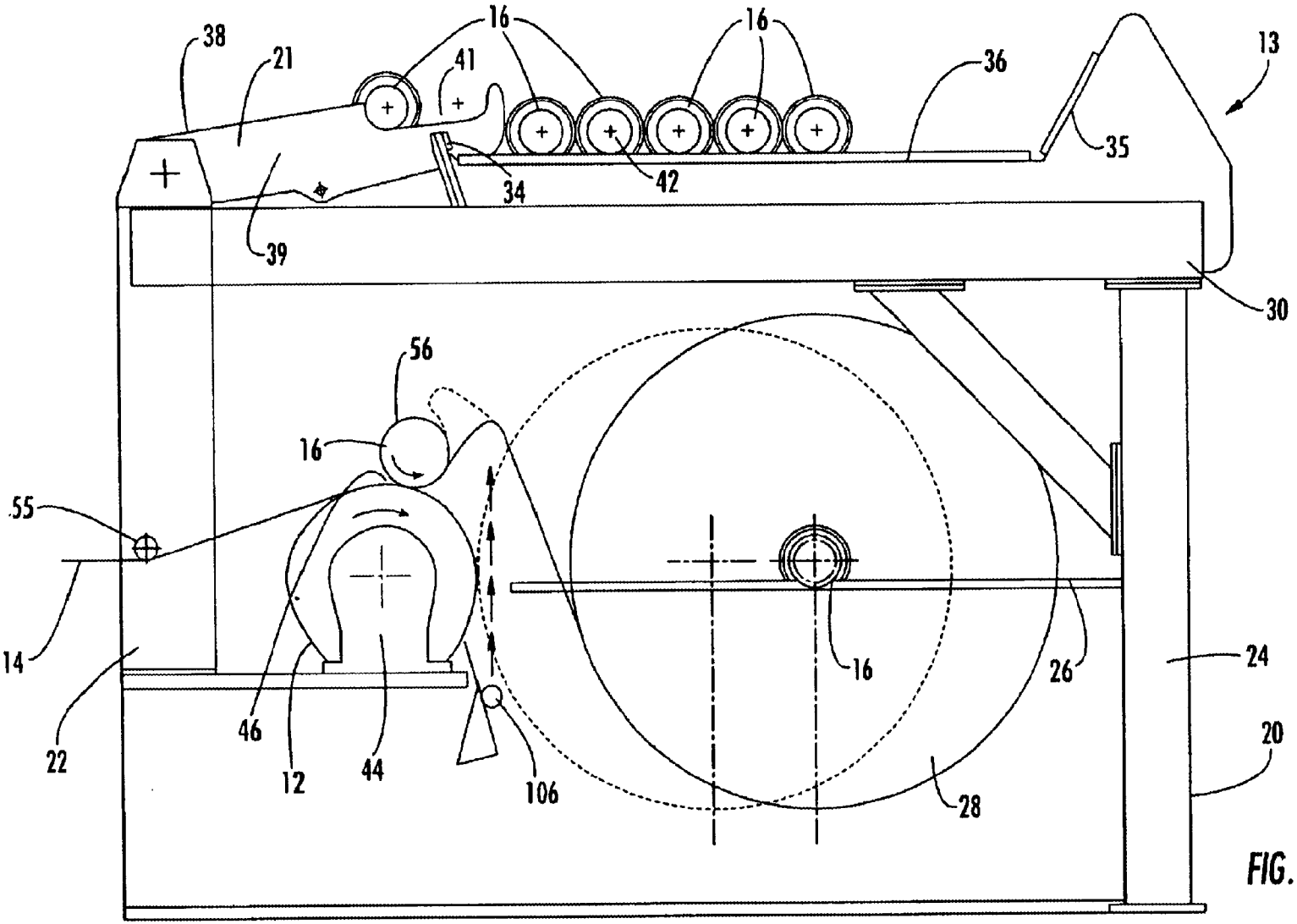

FIG. 6 is an elevated side view of the reel-up device in FIG. 3 showing slack being created in the paper web downstream of the adhesive interface by a blowing device.

Figure 7:
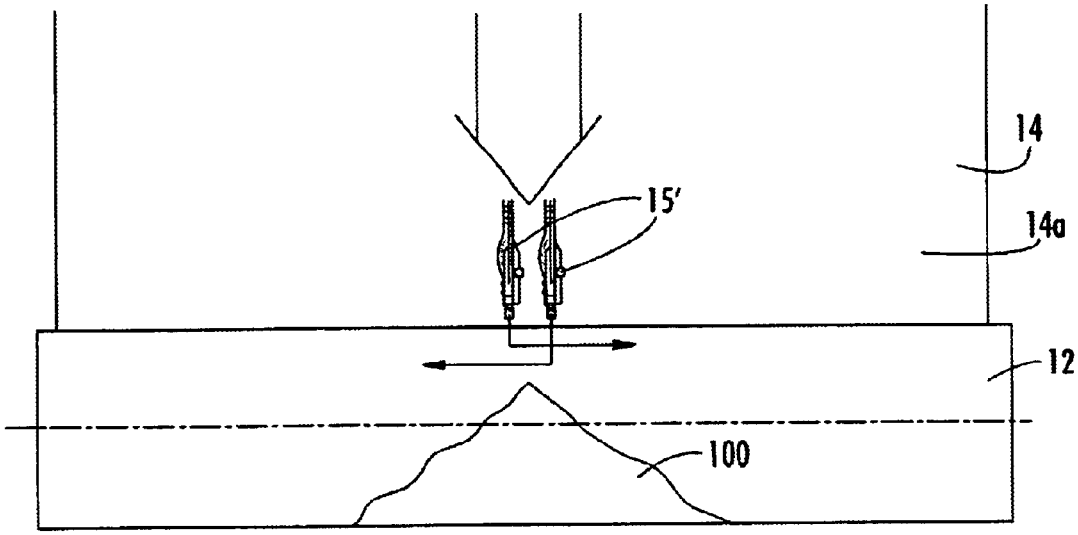

FIG. 7 is a schematic plan view of the leader formed by the pair of nozzles applying an adhesive interface extending diagonally from the center out to the edges in an upstream direction of the web.

Figure 8:
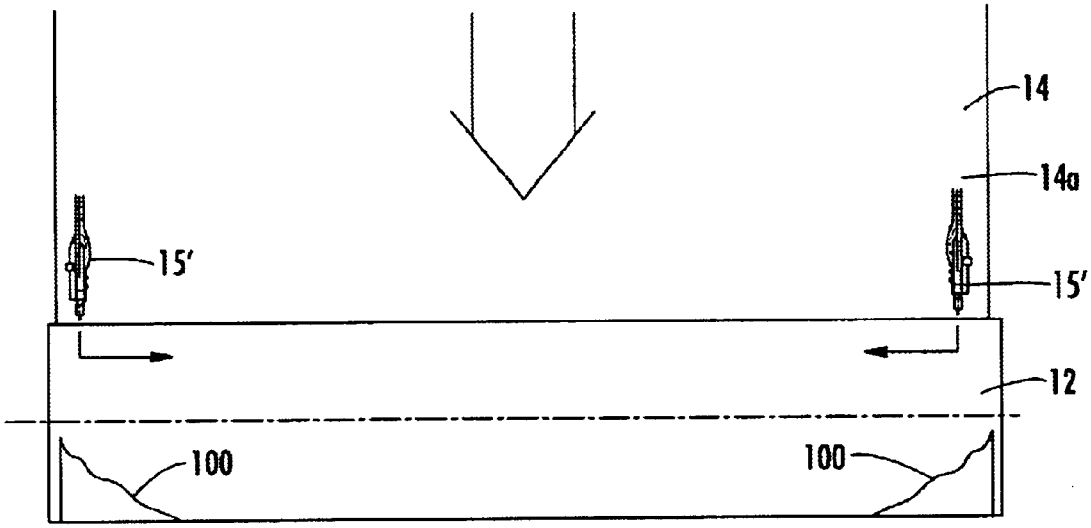

FIG. 8 is a schematic plan view of the leader formed by the pair of nozzles applying an adhesive interface extending from the edges toward the center in an upstream direction of the web.

Figure 9:
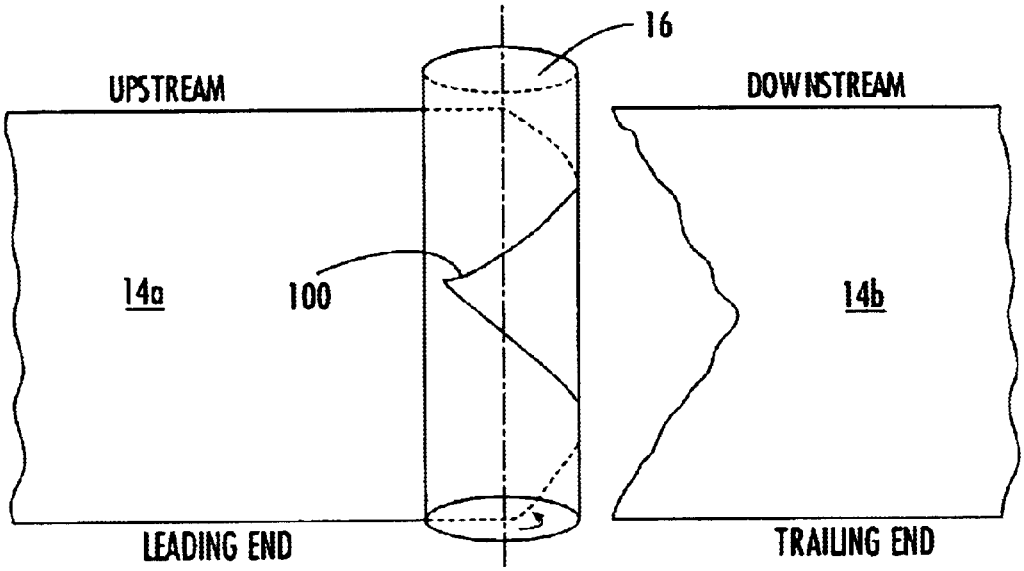

FIG. 9 is a schematic perspective view of the web separated into the leader at the end of the upstream section and the tail end of the completed roll on the downstream end.

Figure 10:
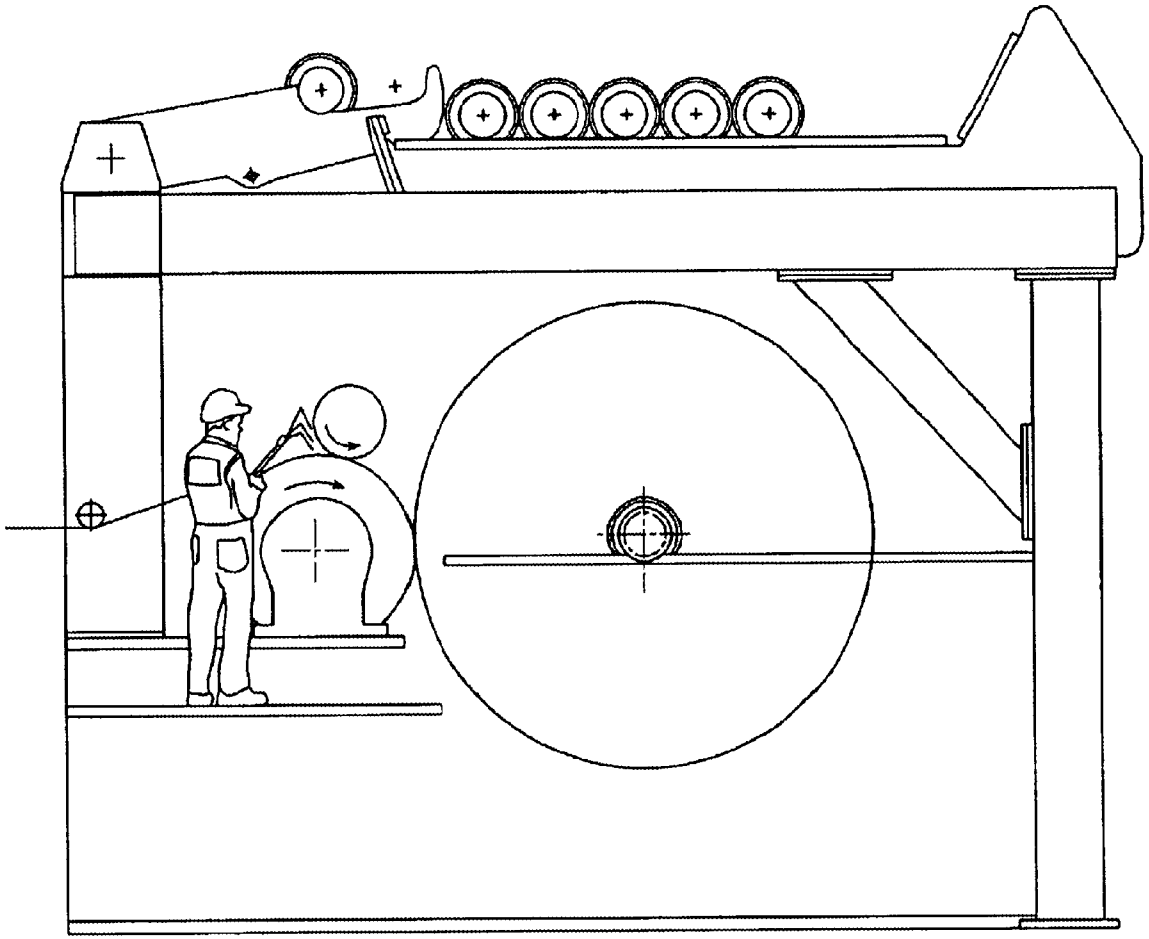
FIG. 10 (PRIOR ART)

FIG. 10 is an elevated side view of a prior art reel-up depicting manual application of the adhesive into the nip of the reel-up.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 through 3 show schematically a first preferred embodiment of a glue-spreading device 11 arranged upstream of a supporting device such as a reel drum 12 in a reel-up 13 of a paper machine. The reel drum 12 supports a continuous paper web 14 during winding. A winding belt could be used in place of the reel drum 12 for supporting the paper web. The glue-spreading device 11 comprises a series of nozzles 15 mounted on a rack 19 transverse to the machine direction and connected by conduits 17 to an adhesive heating hopper 27.

When performing full-width reel switching it is possible according to the invention to apply a thick and sticky adhesive across the paper web so that the whole width of the paper web is covered by jets 18 from the nozzles 15 mounted in the glue-spreading device 11, thereby attaching a web end to a new reel shaft 16 along an adhesive interface 100. The adhesive interface 100 attaches the web 14 to the reel shaft 16 so that rotation of the reel shaft begins the wind-up process and severs the downstream portion of the web from the reel shaft via tension in the web at the adhesive interface, as further described below.

The rack 19 is mounted on a stand 20 of the reel-up 13, on which stand 20 a pair of lowering arms 21, the reel drum 12 and a pair of primary arms (not shown) are also mounted. As shown in FIG. 1, the stand 20 comprises a box like frame of four pillars 22, 23, 24, 25, and a pair of top support beams 30, 31 mounted atop the pillars and extending in the machine direction. Pillars 22 and 23 are at an upstream end of the reel-up 13 and pillars 24 and 25 are at the downstream end of the reel-up 13. The reel-up 13 includes a pair of rails 26 for supporting a completed paper roll 28 with opposite ends of its reel shaft 16 resting on the rails 26.

Stand 20 includes a pair of rails 36 for supporting opposite ends of a plurality of empty reel shafts 16, and a pair of front stops 34 and a pair of rear stops 35 at opposite ends of rails 36. The pair of rails 36 are sloped toward the upstream end of the reel-up 13 and hold a stock of empty reel shafts 16. Empty reel shafts 16 include ends 42 that roll on the pair of rails 36. Each reel shaft 16 is preferably either a metal shaft on which the paper is directly wound, a metal shaft having a paper core tube sleeved over it, or a paper or polymer tube with no metal shaft. The slope of rails 36 urges the empty reel shafts 16 to roll along rails 36 toward the front stops 34 and away from rear stops 35.

Lowering arms 21 comprise plate structures each including a base end 38, a mid portion 39 and a hook portion 41, and are connected to hydraulic cylinders of a hydraulic system (not shown). The base ends 38 are pivotally mounted to stand 20 adjacent the front pillars 22 and 23. Empty reel shafts 16 are retrieved from stand 20 by lowering arms 21.

Lowering arms 21 rotate upwards, propelled by hydraulics, until hook portion 41 engages the nearest empty reel shaft 16 that has rolled, or been moved, up to front stops 34. Lowering arms 21 lower the empty reel shaft by rotating downwards. A pair of primary arms 33 grippingly receive the lowered reel shaft 16 and engage the reel shaft 16 with a drive device (not shown) to rotate the shaft to a peripheral speed matching that of the reel drum 12. The empty reel shaft 16 is then engaged with the reel drum 12.

The reel drum 12 is rotatably journalled to a pair of stand members 44 fixed relative to and disposed adjacent to the rails 26. Over the of surface of reel drum 12 runs the continuous web 14 coming from a production stage of a papermaking machine. The reel drum 12 can be directly driven by a drive motor (not shown) operably coupled to the reel drum 12. The reel drum 12 can have either a solid or flexible surface.

The use of a reel drum 12 in the preferred embodiment is not meant to be limiting, as support for the web 14 could be provided by other types of supporting devices. For instance, the reel drum 12 could be replaced by a moving belt on which the web 14 can be supported and fed onto the reel shaft 16. Another alternative is to use a foil (not shown) as a web supporting device. In one embodiment, the foil has a downstream edge that forms a nip with the reel shaft 16 through which the paper web is guided onto the paper roll. In other embodiments, the foil does not form a nip with the paper roll, in which case there can be a very short free draw between the downstream edge of the foil and the paper roll.

The pair of primary arms 33 support the reel shaft 16 through at least an initial part of the winding process. The pair of primary arms 33 include an actuator (not shown) comprising a pneumatic or hydraulic cylinder that adjusts the radial position of primary arms to allow for increasing diameter of the reel shaft 16 during wind-up. The primary arms 33 also comprise a pivot unit journalled in stand 20 allowing them to cooperate with the reel shaft 16 and to deliver the building reel to a secondary unit (not shown) which then takes over the winding process. The primary arms and secondary units are common in the art of papermaking machines, and thus are not described in any detail herein. The secondary unit completes the winding onto reel shaft 16 to form a completed paper roll 28, after which the completed paper roll 28 is transferred along the pair of rails 16 to a further station.

As shown in FIGS. 1 and 2, the rack 19 includes a horizontal mounting bar 48 that extends in a cross-machine direction between pillars 22 and 23, and a series of generally vertical tube supports 40 affixed to the mounting bar 48. Mounting bar 48 is affixed at its ends 50 through two fixation plates 51 to the inside face of front pillars 22 and 23. Fixation plates 51 can be fixed on the pillars via fasteners or by welding. Tube supports 40 are elongate members that have upper ends affixed to a member (not shown) that extend between front pillars 22 and 23 and extend downward to attach at their lower ends to mounting bar 48.

A more specific description of the glue spreading device 11 of the current invention will reveal its advantages over conventional reel changing systems. The glue spreading device 11 combines the advantages of automatic glue application with automatic severing of the downstream end of the paper web 14 at the adhesive interface 100. Automating both operations greatly speeds reel switching, which in turn, increases manufacturing throughput of the papermaking machine. Combining the gluing step with an automatic severing process also ensures that the paper web 14 is firmly anchored to the new reel shaft 16 without additional, post-severing, steps.

Although various types of glue can be used, the device described herein preferably employs a glue that has a high tack and a relatively high viscosity. The glue (or adhesive) has some unique characteristics that distinguish it from other types of glues. The glue at room temperature can be solid or semi-solid (e.g., gel-like), but when heated its viscosity becomes much lower so that it can be sprayed from the nozzles 15.

These characteristics are advantageous for several reasons. Nozzles 15 and conduits 17 are less likely to clog or suffer from build up and contamination because heating of any residual glue in the system renders the glue flowable. The invention thus reduces down time for maintenance. Once the glue application is completed and the heating of the glue discontinued, the glue returns to its solid or semi-solid state, and hence is less likely to drip or run compared with conventional liquid adhesives. This minimizes dripping of glue onto the web which could result in sequential turns of web in a completed roll being stuck to each other, leading to a waste of paper.

The heated adhesive promotes efficient severing of the paper web 14 at the adhesive interface 100. Once the heated adhesive cools, its increased tackiness binds the web 14 to the reel shaft with a strength that exceeds the tension necessary to tear the web. Other high tack adhesives (i.e., thick and sticky) that do not require heating may also be used if they bind the web 14 with sufficient strength.

Nozzles 15, conduits 17 and an adhesive heating hopper 27 advantageously can comprise a Dynatec heated adhesive application system available from ITW Dynatec of Hendersonville, Tenn. As shown in FIGS. 1 and 2, the pair of nozzles 15 are each attached to an individual conduit 17 of heated, flexible hose or pipe which carries a glue supply from an adhesive heating hopper 27. The adhesive heating hopper 27 includes a heated hopper grid (not shown) for heating the adhesive to make the adhesive flowable. A driving device (not shown) is connected to, or incorporated in, the hopper for dispensing the adhesive through the conduits 17. The driving device can be an internal piston pump in the hopper for pumping the flowable adhesive, or can be a source of pressurized air coupled with the hopper.

During web reeling, the continuous web 14 travels over a guide roll 55 and into a nip 46 formed between reel shaft 16 and reel drum 12. The glue-spreading device 11 is positioned in this embodiment on the upstream side of the nip 46 to spray glue on the paper web 14 just before it enters the nip. Nozzles 15 are mounted on mounting bar 48 pointing in a downward direction (towards web 14) and at a slight angle in the direction of nip 46.

The previous description of the positioning of the nozzles 15 is not meant to be limiting. Formation of the adhesive interface 100 occurs when the adhesive binds the web 14 to the reel shaft 16 and can be accomplished using several methods. The nozzles 15 can be positioned to spray jets of adhesive onto the web 14 and the reel shaft 16 together, to the web alone, or to the reel shaft alone. As windup or reel-up begins, the web 14 is brought into contact with the reel shaft 16 and wherever the adhesive has been applied, the adhesive interface 100 is formed.

As shown in FIG. 2, six nozzles 15 are mounted on mounting bar 48 at equal intervals in the cross-machine direction. Conduits 17 extend from the hopper 27 upwards to wrap around the top of front pillar 22 and then extend as a group in a cross-machine direction toward pillar 23. Each conduit 17 separates from the group and drops downward and along each tube support 40 to connect to a respective nozzle 15. Thus, the tube supports 40 provide support for the individual conduits 17 which are preferably constructed of heated and flexible hose which maintains the adhesive at a predetermined temperature. Alternatively, it would be possible to construct conduits 17 from rigid piping which would not require support members.

Empty reel shafts 16 are retrieved from stand 20 by lowering arms 21. Lowering arms 21 rotate upwards, propelled by hydraulics, until hook portion 41 engages the nearest empty reel shaft 16 that has rolled, or been moved, up to front stop 34. Lowering arms 21 lower the empty reel shaft by rotating downwards. Primary arms 33 receive the lowered reel shaft 16 and grip it via reeling shaft grippers 47, and typically engage the reel shaft 16 with a drive device (not shown) to rotate the drum to a peripheral speed matching that of the reel drum 12. The empty reel shaft 16 is then engaged with the reel drum 12.

The glue-spreading device 11 is activated by heating the adhesive (e.g., Swift Adhesives C968/103) in the adhesive heating hopper 27 to about 75° C., or to a temperature sufficient to reduce the viscosity of the adhesive to a point enabling the adhesive to be pumped to the nozzles 15. The temperature of the adhesive is maintained while the adhesive is pumped to nozzles 15 via the heated conduits, hoses or pipes 17.

Jets 18 of adhesive are emitted from nozzles 15. Preferably, the jets 18 are activated for a predetermined period of time, but could also be activated in different ways if desired. For instance, the nozzles 14 could be opened in turn, or in a predetermined order for varying time periods. The jets 18 are preferably dispersed in a flat fan, or fishtail-like, spray that applies adhesive in an even line transverse to the machine direction. After the glue exits nozzles 15, it immediately begins to cool, gaining viscosity and stickiness. Once the glue reaches room temperature, it returns to its original (e.g., semi-solid, or gel like) state that is resistant to runs and drips. Thus, its spray pattern is even, consistent and sticky.

The web 14 is advanced through nip 46 where the applied glue on the top side of web 14 encounters the outer surface 56 of reel shaft 16. The glue sticks to the outer surface 56 of reel shaft 16 and web 14 becomes secured to the reel shaft 16 to form the adhesive interface 100.

Additional advancement of the web 14 begins to introduce tension into the web and an upstream portion 14*a* of the web that is upstream from the adhesive interface 100 continues to wind along the reel shaft 16 and a downstream portion 14*b* of the web that is downstream from the adhesive interface folds backwards. As the adhesive interface 100 rotates away from the previously completed paper roll, the tension in the downstream portion 14*b* of the web 14 increases. The web 14 begins to sever along the adhesive interface 100, starting at the parts of the boundary of the adhesive interface located farthest downstream along the web, as shown in FIG. 3. Once severed, the downstream portion 14*b* becomes the tail end that winds onto the previously completed paper roll 18.

As shown in FIG. 6, turn-up of the web onto the reel shaft 16 can be aided by a blowing device 106 for balloon blowing that is mounted in a cross-machine direction below the web 14 and downstream of the reel drum 12. The blowing device 106 blows in the direction of arrows 107 into the underside of the paper web 14. Simultaneously, the rotation of the fully wound paper roll 28 is slowed down while the roll 28 is moved away from the reel drum 12. The slowing of the paper roll 28 creates slack in the downstream portion 14*b* and the blowing device 106, blows on this downstream portion causing the paper web to arc upwards and begin to wrap around the reel shaft. As the shaft rotates, the slack is then abruptly taken out and the web tears at the adhesive interface 100.

Different temperatures, pressures and glue types can be adapted to the various needs of different web materials. The invention is particularly well suited to the reel-up and severing of fragile tissue papers for sanitary uses. However, the invention can be used for winding of any grade of paper. Some advantages can be gained from different methods of applying the adhesive interface 100 as will be shown by other embodiments.

FIGS. 4 through 9 show second and third embodiments wherein the glue-spreading device 11 comprises a pair of translating nozzles 15' translated by a pair of rodless cylinders 101 and connected to an adhesive supply (not shown) via a pair of conduits 17 housed in a pair of cable tracks 102.

The pair of nozzles 15' are mounted on the pistons of the pair of rodless cylinders 101, pointing in a downward direction (towards web 14) and at a slight angle in the direction of nip 46. The rodless cylinders 101 are parallel to each other and extend transverse to the machine direction. The cylinders 101 are positioned one above the other, and with sufficient clearance between them to ensure that the nozzles 15' do not collide during transverse movement. The cylinders 101 are fixed to the rack 19 which also provides support for the pair of cable tracks 102. The cable tracks 102 carry the pair of conduits 17 (one conduit in each track) that supply the pair of nozzles 15' with adhesive. The cable tracks 102 are flexible, segmented housings that protect and support the conduits 102 during motion of the translating nozzles 15'.

There are two preferred paths of travel for nozzles 15', as shown in FIGS. 7, 8 and 9. In a first path of travel, shown in FIGS. 7 and 9, the pair of translating nozzles 15' are placed in the middle with respect to the width of the paper web prior to adhesive application. The nozzles 15' move outwards from the middle position, initially passing each other, to the edges of the paper width while spraying adhesive. Depending on their placement and orientation, the pair of nozzles 15' can apply adhesive while moving along their path to the web 14 and the reel shaft 16 together, to the web alone, or to the reel shaft alone. The following description assumes that the adhesive is applied only to the web 14, but similar results are obtained when the adhesive is applied only to the reel shaft 16 or to both the web and the reel shaft.

The combined movement of the web 14 and the transverse movement of the pair of nozzles 15' result in the adhesive on the web extending diagonally from the center out to the edges in an upstream direction of the web. The translating nozzles 15' preferably should be moved as quickly as possible to minimize the leader length in the machine direction. Accordingly, the motions of the nozzles 15' preferably are motivated by the rodless cylinders 101. However, other types of actuation devices could alternatively be used.

Additional advancement of the web 14 increases the tension in the downstream portion of the web 14*b*. The web 14 begins to sever along the adhesive interface 100, starting at a point in the center and advancing in a spiral to both edges of the web 14. Once severed, the downstream portion 14*b* of the web 14 becomes the tail end that winds onto the previously completed paper roll 18. The ability of the pair of nozzles 15' to translate is advantageous in that the adhesive interface 100 is applied in a smooth line that promotes a smooth, progressive tear without tattered edges.

The third embodiment shown in FIG. 8 depicts the shape of the adhesive interface 100 when the pair of nozzles 15' begin at the edges of the web 14 and translate to the center of the width of the web. The adhesive interface 100 extends from the edges of the web 14 to the center in the upstream direction. The, shape of the adhesive interface 100 in both embodiments has an advantage over the prior art in that the length of the leaders 103 and 105 are much shorter than a straight, angular leader that starts at one edge of the web 14 and travels to the other edge. Also, the high speed of the translating nozzles 15' minimizes the length of the leaders 103 and 105.

Other leader shapes are also possible, depending upon the shape of the adhesive interface 100. The pair of translating nozzles 15' could start in the center of the web 14 as in the first embodiment, but not cross paths. This would result in a leader shape that would leave a strip of the web 14 in the middle which would have to be torn free without the aid of the adhesive interface 100.

Many modifications and other embodiments of the invention will come to mind to one skilled in the art to which this invention pertains having the benefit of the teachings presented in the foregoing descriptions and the associated drawings. For example, although the invention is explained by reference to a preferred embodiment in which adhesive is sprayed from nozzles onto the web and/or reel shaft, alternatively other methods and devices can be used for applying the adhesive to the web and/or reel shaft. For instance, a brush could be used for applying the adhesive on the reel shaft. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for winding a traveling web of fibrous material, comprising the steps of:

guiding the web toward a rotating reel shaft;

applying an adhesive onto at least one of the web and the reel shaft;

initiating contact between the web and the reel shaft such that the web adheres to the reel shaft forming an adhesive interface therebetween, a trailing end of the web extending from the adhesive interface in a downstream direction, and a leading end of the web extending from the adhesive interface in an upstream direction; and severing the web at the adhesive interface by applying tension to the trailing end of the web in the downstream direction, the adhesive preventing the web from detaching from the reel shaft such that the trailing end of the web tears free of the leading end at the adhesive interface.

2. The method of claim 1, further including the step of heating the adhesive to a predetermined temperature in a tank with a heater to render the adhesive flowable and dispensing the flowable adhesive to the nozzle.

3. The method of claim 2, further including the step of translating the nozzle in a cross-machine so as to apply adhesive on at least one of the web and the reel shaft along an entire width of the web.

4. The method of claim 2, wherein said applying step includes spraying an adhesive from a spray nozzle onto at least one of the web and the reel shaft.

5. The method of claim 4, further including the steps of providing a second nozzle, positioning the first and second nozzles at opposite edges of the web and translating the first and second nozzles to a center of the web so as to spray an adhesive on at least one of the web and the reel shaft along an entire width of the web.

6. The method of claim 4, further including the steps of providing a second nozzle, positioning the first and second nozzles proximate a center of a width of the web and translating the first and second nozzles to opposing edges of the web so as to spray an adhesive on at least one of the web and the reel shaft along an entire width of the web.

7. The method of claim 2, wherein said applying step further comprises applying adhesive from a plurality of fixed nozzles onto at least one of the web and the reel shaft, the nozzles being spaced apart in a cross-machine direction.

8. The method of claim 7, wherein said applying step includes spraying the adhesive from the plurality of fixed nozzles onto at least one of the web and the reel shaft.

9. The method of claim 8, wherein said applying step includes spraying said adhesive from each nozzle in a fan shaped jet so as to create a continuous adhesive interface across a width of the web.

10. The method of claim 5, wherein said spraying step further comprises spraying adhesive onto the web upstream of the reel shaft.

11. The method of claim 5, wherein said spraying step further comprises spraying adhesive into a nip between the reel shaft and a winding surface.

12. The method of claim 5, wherein said spraying step further comprises spraying adhesive onto the reel shaft.

13. The method of claim 6, wherein said spraying step further comprises spraying adhesive onto the web upstream of the reel shaft.

14. The method of claim 6, wherein said spraying step further comprises spraying adhesive into a nip between the reel shaft and a winding surface.

15. The method of claim 6, wherein said spraying step further comprises spraying adhesive onto the reel shaft.

16. The method of claim 2, further including the step of controlling a tear pattern along which the web tears by controlling a pattern in which adhesive is applied to the at least one of the web and the reel shaft.

17. The method of claim 16, wherein the step of controlling a tear pattern includes applying adhesive so that a boundary line of the adhesive interface extends diagonally from a center of the web out to both edges of the web in the upstream direction.

18. The method of claim 16, wherein the step of controlling a tear pattern includes applying adhesive so that a boundary line of the adhesive interface extends diagonally from both edges of the web to a center of the web in the upstream direction.

19. The method of claim 1, further including the steps of providing a second nozzle, wherein a range of movement of the first nozzle overlaps a range of movement of the second nozzle.

* * * * *

UNITED STATES PATENT AND TRADEMARK OFFICE

CERTIFICATE OF CORRECTION

PATENT NO. : 6,705,560 B1
DATED : March 16, 2004
INVENTOR(S) : Rågård et al.

It is certified that error appears in the above-identified patent and that said Letters Patent is hereby corrected as shown below:

Title page,
Item [73], Assignee, "Aktiebolg" should read -- Aktiebolag -- and "Kalstad (SE)" should read -- Karlstad (SE) --.

Signed and Sealed this

Twenty-first Day of June, 2005

JON W. DUDAS
*Director of the United States Patent and Trademark Office*